US006032622A

United States Patent [19]

Schmied

[11] Patent Number: 6,032,622

[45] Date of Patent: Mar. 7, 2000

[54] INTERNAL COMBUSTION CYLINDER ENGINE

[75] Inventor: Walter Schmied, Valdez, Ak.

[73] Assignees: Christina Dix, Fairbanks; Robert D. Preston; Victoria Preston, both of Valdez; Christopher Lee Cook, Slana; Gregory Black; Gwendolyn Black, both of Sutton, all of Ak.; Roger Collin; Georgia Collin, both of Elk, Calif.; Herman A. Dillbeck, Slana; Scientific Motor Works, Inc., Fairbanks, both of Ak.; Jim Graham; Carol Graham, both of Bonners Ferry, Id.; Joseph P. Kilian, Jr., Valdez, Ak.; Michael Jolliffe, Fort Bragg; Landbank Properties, Inc., Mendocino, both of Calif.; The Kearney Living Trust, Dated, Mendocino, Calif.

[21] Appl. No.: 08/926,088

[22] Filed: Sep. 2, 1997

[51] Int. Cl.[7] ..... F01L 7/00

[52] U.S. Cl. ..... 123/42

[58] Field of Search ..... 123/43 R, 42, 123/44 C, 44 A, 57.1

[56] References Cited

U.S. PATENT DOCUMENTS

| | | | |
|---|---|---|---|
| 1,019,856 | 3/1912 | Strickland | 123/42 |
| 3,931,809 | 1/1976 | Corte et al. | 123/43 R |
| 4,058,088 | 11/1977 | Brown | 123/43 R |
| 4,838,214 | 6/1989 | Barrett | 123/42 |
| 5,103,775 | 4/1992 | Hue | 123/43 R |
| 5,456,219 | 10/1995 | Clarke | 123/42 |
| 5,647,307 | 7/1997 | Clarke | 123/42 |

*Primary Examiner*—Marguerite McMahon
*Attorney, Agent, or Firm*—Christensen O'Connor Johnson & Kindness PLLC

[57] ABSTRACT

An internal combustion engine is provided. The engine includes a housing (9) having at least first and second pairs of chambers (20) formed in the housing. Each chamber extends from the exterior of the housing to a predetermined point therein. The first pair of chambers being aligned with the housing along a first axis and the second pair of chambers being aligned within the housing along a second axis extending substantially normal to the first axis. The engine further including a plurality of piston assemblies (6). Each chamber having one of the piston assemblies rigidly fastened thereto. A cylinder (1) is reciprocally mounted on an elongate cylinder pin assembly (2). The cylinder pin assembly extending within the housing and disposed between the cylinders for reciprocating the cylinders along a predetermined stroke length and relative to the fixed piston assemblies in an opposed manner during operation of the engine. The cylinder pin assembly having two axes of rotation. The engine also including a power takeoff shaft (12) coupled to an end of the cylinder pin assembly for transmitting energy generated by operation of the engine.

21 Claims, 17 Drawing Sheets

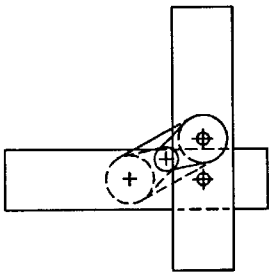
Fig. 16A.
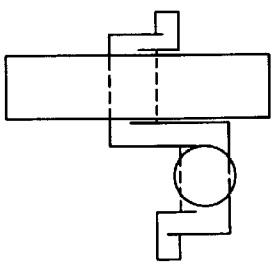
Fig. 16B.
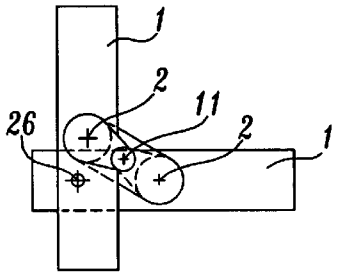
Fig. 16C.
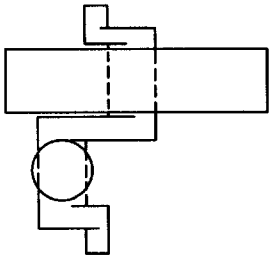
Fig. 16D.
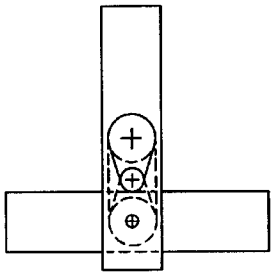
Fig. 16E.
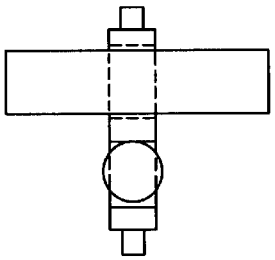
Fig. 16F.
Fig. 16G.
Fig. 16H.

INTERNAL COMBUSTION CYLINDER ENGINE

FIELD OF THE INVENTION

The present invention is directed generally to internal combustion engines and, more particularly, to four cylinder two-stroke reciprocating engines.

BACKGROUND OF THE INVENTION

As is well known, an internal combustion engine is a machine for converting heat energy into mechanical work. In an internal combustion engine, a fuel-air mixture that has been introduced into a combustion chamber is compressed as a piston slides within the chamber. A high voltage for ignition is applied to a spark plug installed in the combustion chamber to generate an electric spark to ignite the fuel-air mixture. The resulting combustion pushes the piston downwardly within the chamber, thereby producing a force that is convertible to a rotary output.

Such internal combustion engines have a variety of problems. First, because of the multitude of moving parts, such engines are costly to assemble. Further, because of the moving parts, such an engine is subjected to a shortened useful life due to frictional wear between the moving parts. Finally, because of the multiple parts, such an engine is heavy.

Thus, there exists an need for an internal combustion engine that not only produces a high power-to-weight ratio, but is also economical to manufacture, has a high degree of reliability and has less moving parts than reciprocating engines currently available.

SUMMARY OF THE INVENTION

In accordance with the present invention, an internal combustion engine is provided. The engine includes a housing having first and second chambers formed in opposite ends of the housing. The chambers extend from the exterior of the housing to a predetermined point therein. The engine also includes a first piston assembly rigidly fastened to one of the chambers and a second piston assembly fastened to the other of the chambers. A cylinder is reciprocally mounted within each of the chambers, such that a portion of the first piston assembly is received within each cylinder. The engine also includes a reciprocating and rotating mechanism. The reciprocating and rotating mechanism includes at least one end rotatably disposed within the housing for transferring energy from the engine to a power take off shaft attachable to the end of the mechanism. The reciprocating and rotating mechanism is disposed between the cylinders for reciprocating the cylinders along a predetermined stroke length and relative to the fixed piston assemblies during operation of the engine.

In accordance with further aspects of this invention, the reciprocating and rotating mechanism rotates about two axes of rotation. The first axis of rotation is defined by a longitudinal axis extending through the reciprocating and rotating mechanism. The second axis of rotation is defined by a longitudinal axis extending normal to a point defined midway between the ends of the stroke length.

In accordance with other aspects of this invention, the internal combustion engine also includes at least one intake port and at least one exhaust port extending through the cylinders. The intake port and exhaust port are vertically spaced within each cylinder.

In accordance with still yet other aspects of this invention, the internal combustion engine further includes third and fourth chambers formed in opposite ends of the housing and orthogonally to the first and second chambers. The third and fourth chambers each includes a piston assembly rigidly fastened to the chambers. The third and forth chambers further include cylinders reciprocally mounted therein on the reciprocating and rotating mechanism for operation as a four cylinder internal combustion engine.

An internal combustion formed in accordance with the present invention has several advantages over currently available engines. Such an engine is easy and economical to manufacture, maintain and overhaul. Because the cylinders are reciprocated relative to fixed pistons, it has less moving parts than existing reciprocating engines. Because of the lower part count, such an engine is lighter and, therefore, has a high power-to-weight ratio. Finally, such an engine is easily adaptable for a variety of engines, such as two-stroke, diesel and gasoline powered internal combustion engines. Thus, an internal combustion engine formed in accordance with the present invention is economical to produce, has high reliability and has less moving parts than currently existing reciprocating engines.

BRIEF DESCRIPTION OF THE DRAWINGS

The foregoing aspects and many of the attendant advantages of this invention will become better understood by reference to the following detailed description, when taken in conjunction with the accompanying drawings, wherein:

FIG. 16 illustrates the cylinder motion for an internal combustion engine formed in accordance with the present invention.

DETAILED DESCRIPTION OF THE PREFERRED EMBODIMENT

An internal combustion cylinder engine formed in accordance with the present invention suitably operates on the two cycle principle. The engine of the present invention is distinguished from those currently available through the use of one double cylinder 1 for each double cylinder housing 9. Through the center of the double cylinder 1 is cylinder journal pin 2. The cylinder journal pin 2 is suitably disposed therein on bearings (roller- or other) 10. The cylinder journal pin 2 is turnable. A connecting rod does not exist.

Figure 11:
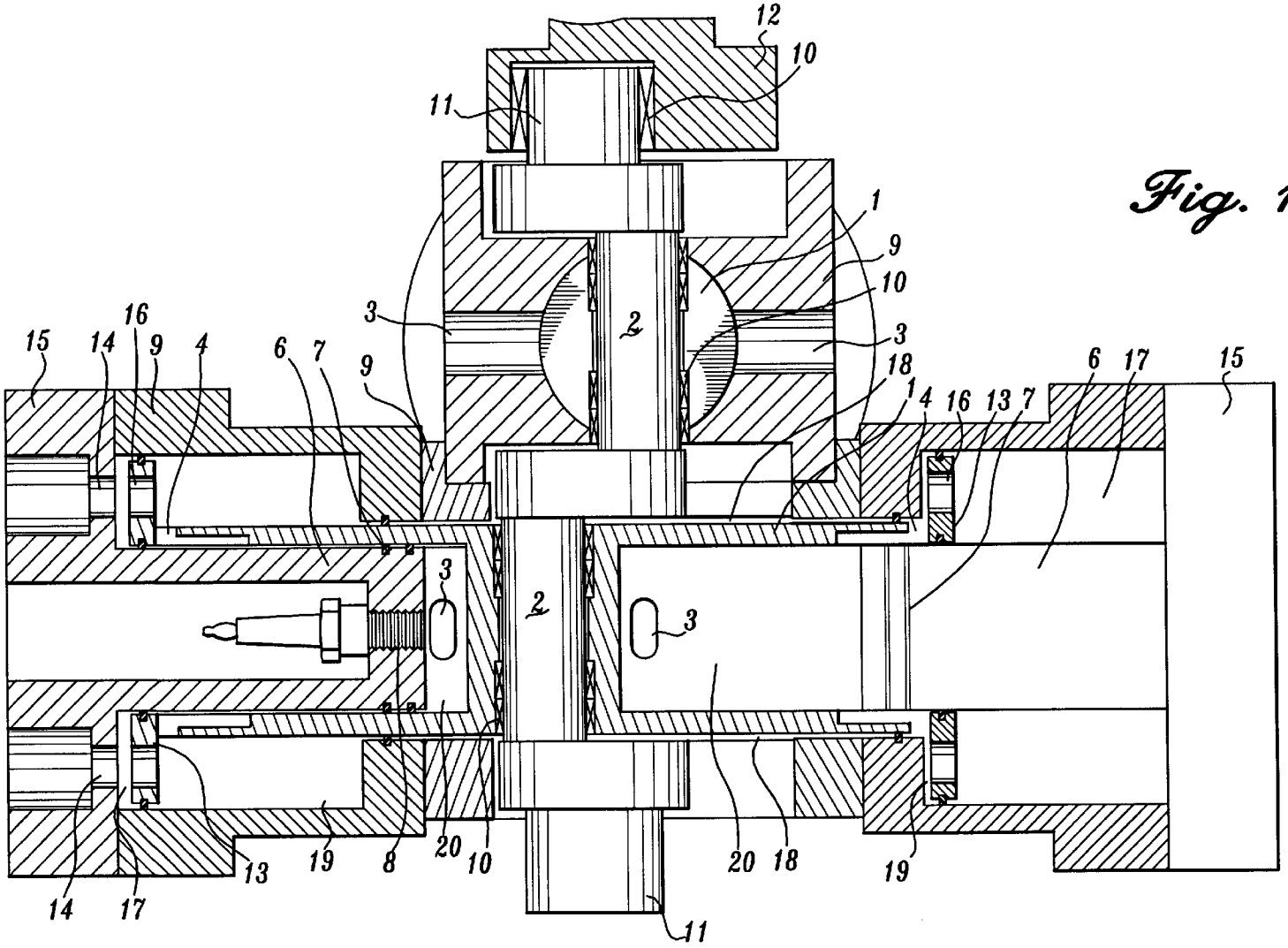
FIG. 11 is a cross-sectional view of an internal combustion engine formed in accordance with the present invention showing the major components of the engine.

Exhaust 3 and intake ports 4 are located on the opposite ends of the cylinder bore. As seen in FIG. 11, the exhaust and intake ports 3 and 4 are vertically spaced. This is different to the diametrical opposed intake and exhaust ports of known two cycle engines.

The intake ports 4 can be placed around the whole circumference of the cylinder. The exhaust ports 3 may be located on both sides of the diameter of the cylinder.

Figure 5:
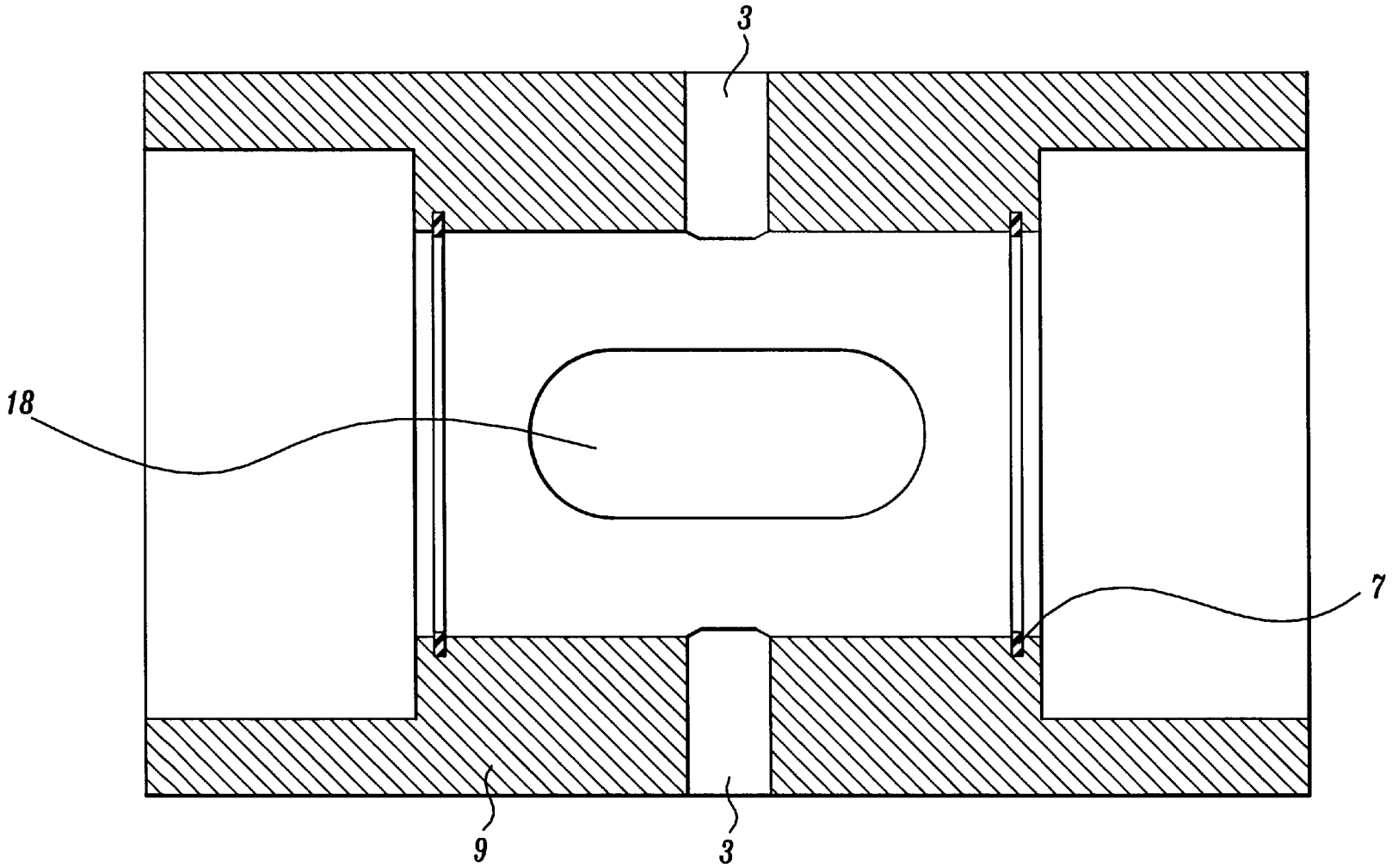
FIG. 5 is a cross-sectional view of an internal combustion engine formed in accordance with the present invention showing the cylinder journal pin slots, exhaust ports, housing and piston rings.
Figure 8C:
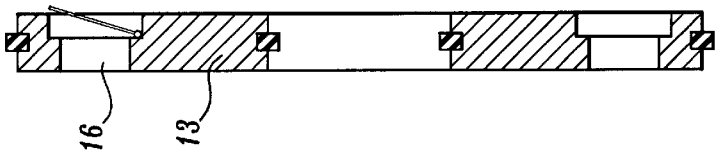
FIG. 8C is a cross-sectional end view of a precompression plate for an internal combustion engine formed in accordance with the present invention.
Figure 8B:
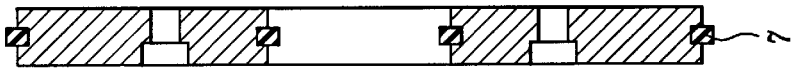
FIG. 8B is a cross-sectional end view of a precompression plate for an internal combustion engine formed in accordance with the present invention.
Figure 8A:
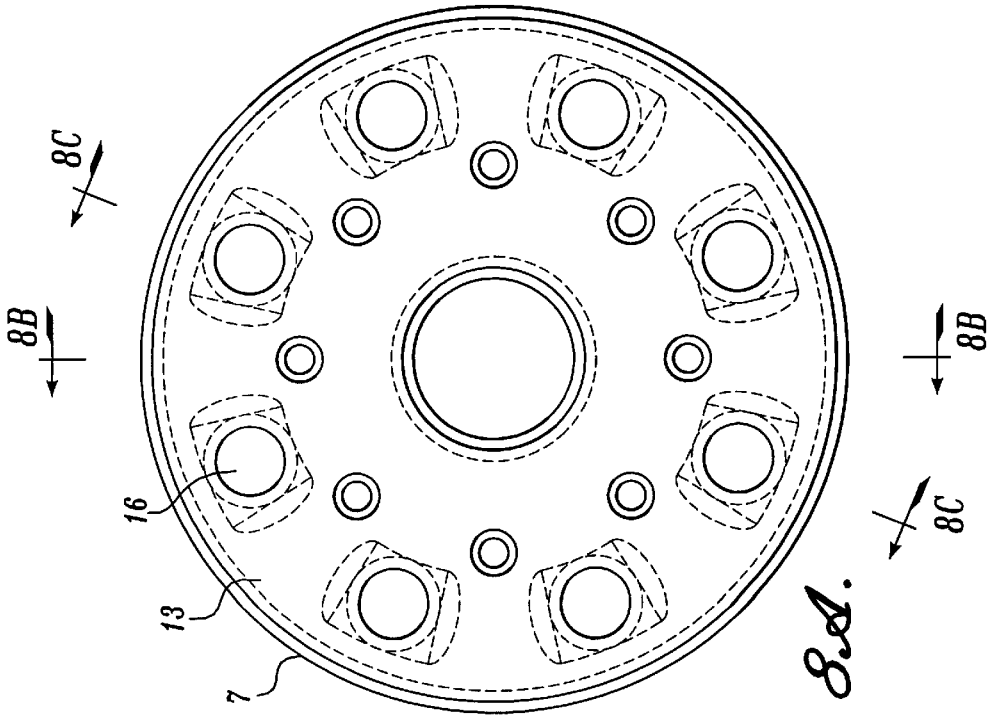
FIG. 8A is a top view of a precompression plate for an internal combustion engine formed in accordance with the present invention.
Figure 9:
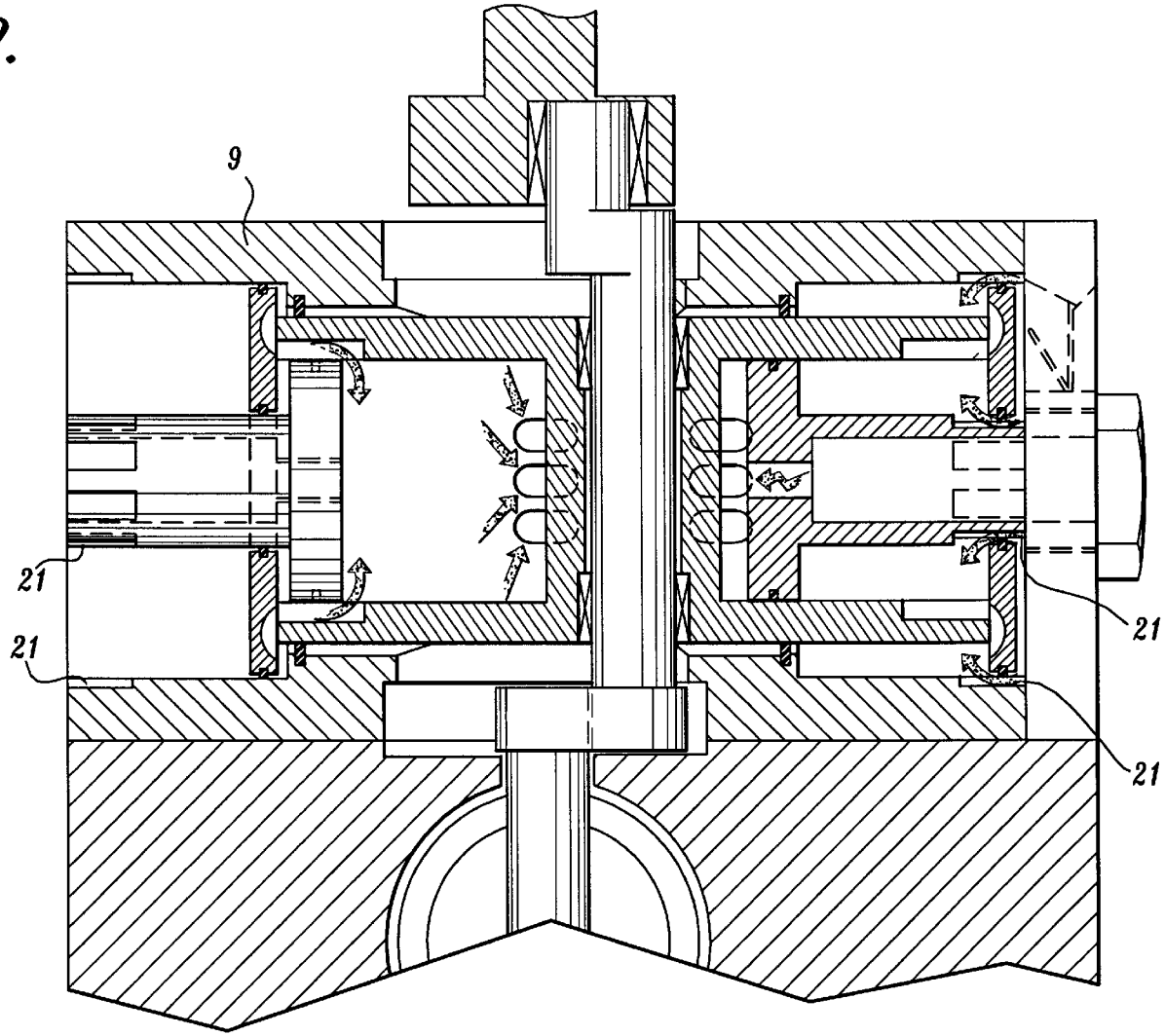
FIG. 9 is a cross-sectional side view of an internal combustion engine formed in accordance with the present invention showing the entrance of a fuel-air mixture into the combustion chamber and exhaustion of exhaust gases through the exhaust ports.
Figure 10:
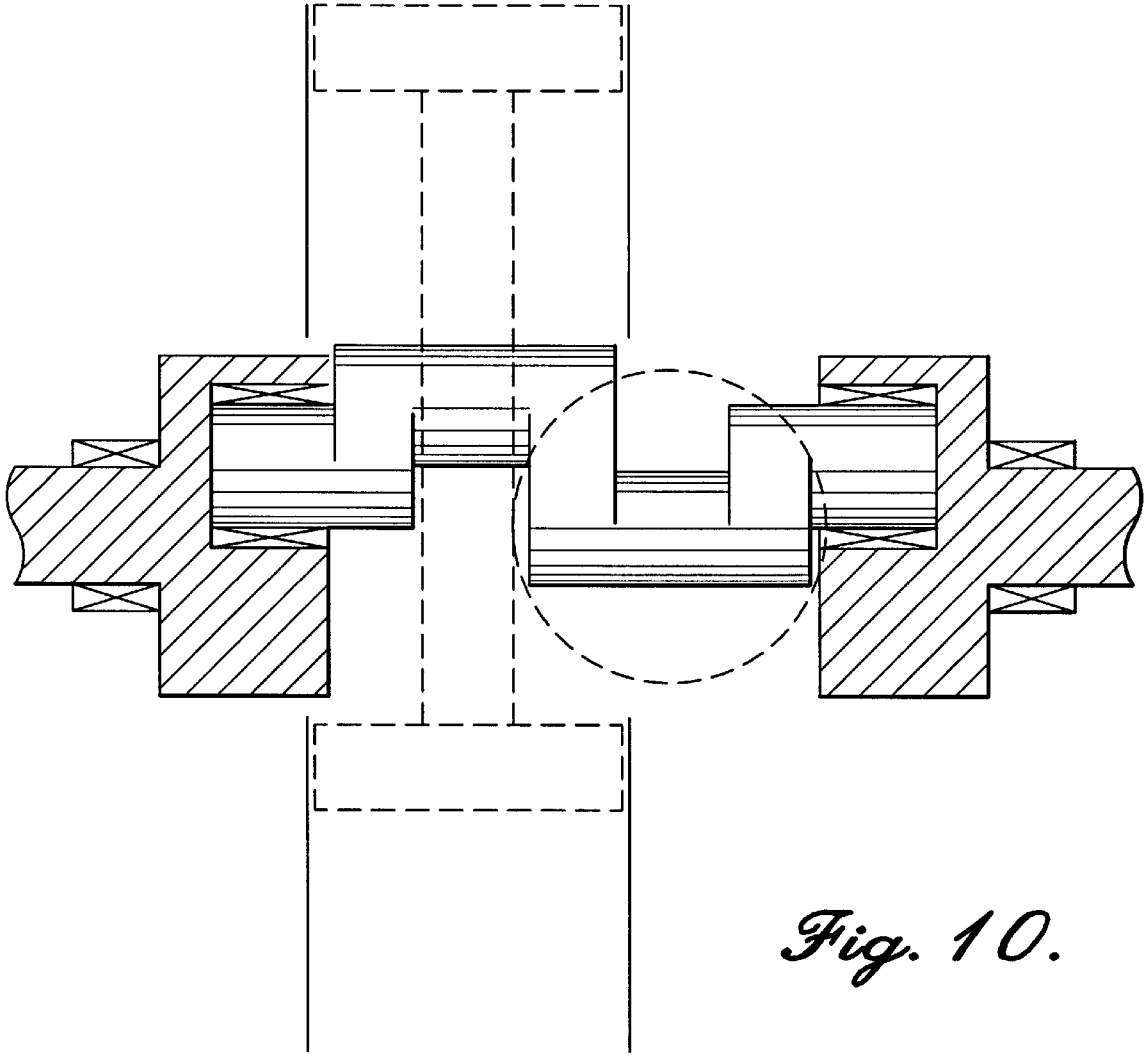
FIG. 10 is a cross-sectional side view of an internal combustion engine formed in accordance with the present invention showing a power take off shaft attached to the ends of the reciprocating and rotating mechanism.

Referring to FIGS. 5 and 8 exhaust ports 3 are located on both sides of the cylinder housing 9. The exhaust ports are centrally located and are alternately shared with the exhaust ports 3 of both the double cylinders when the cylinders are in the bottom dead end position.

The engine also includes pistons 6. The pistons 6 are stationary and are not a moving part of the engine. The pistons 6 can be adjusted for different compression ratios.

The pistons 6 contain a spark plug or injector hole 8 and piston rings 7. The injection hole 8 is suitable for an alternate embodiment of the engine, such as a diesel engine.

Figure 6:
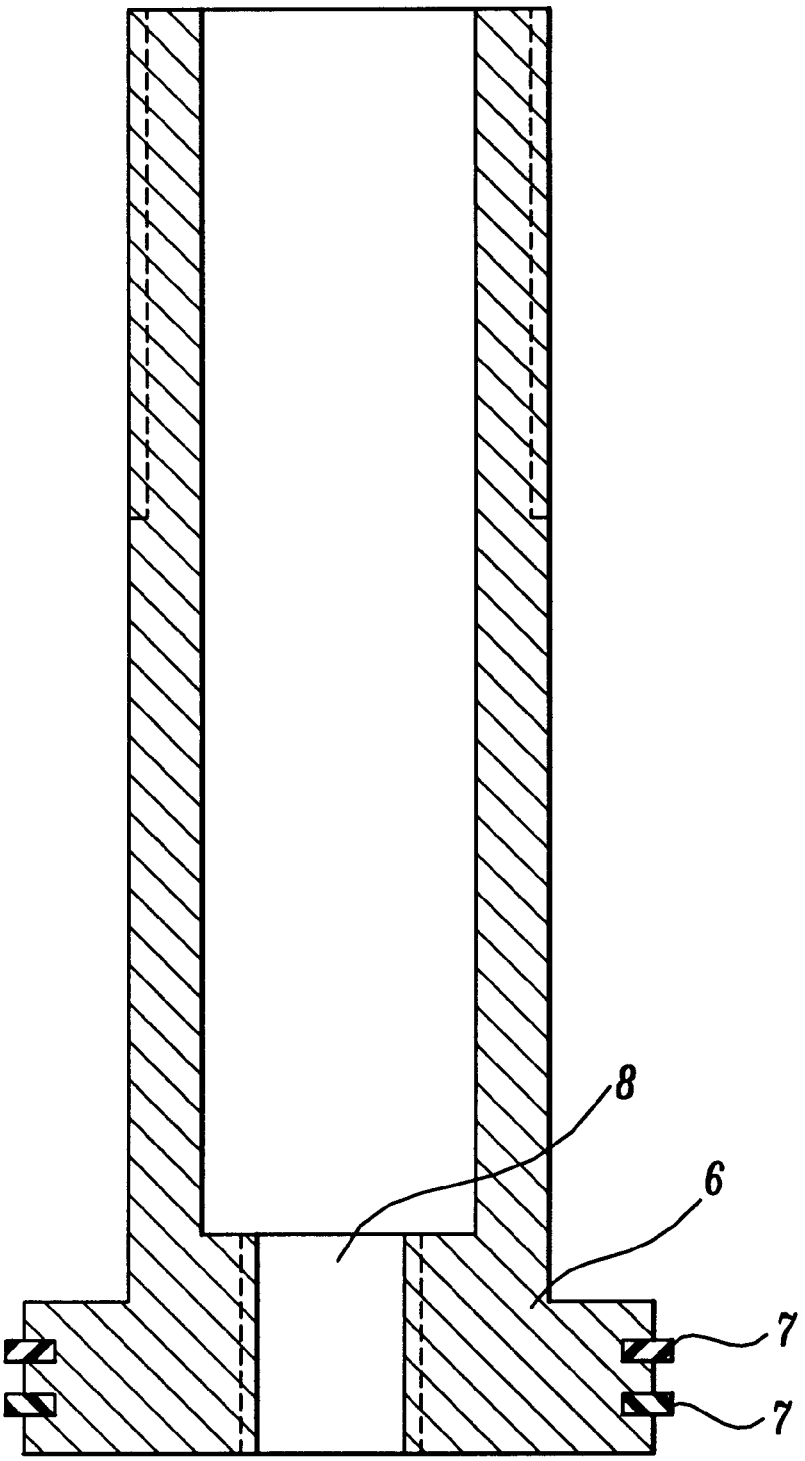
FIG. 6 is a cross-sectional view of a piston for an internal combustion engine formed in accordance with the present invention showing the piston rings and the spark plug or injector hole.
Figure 7:
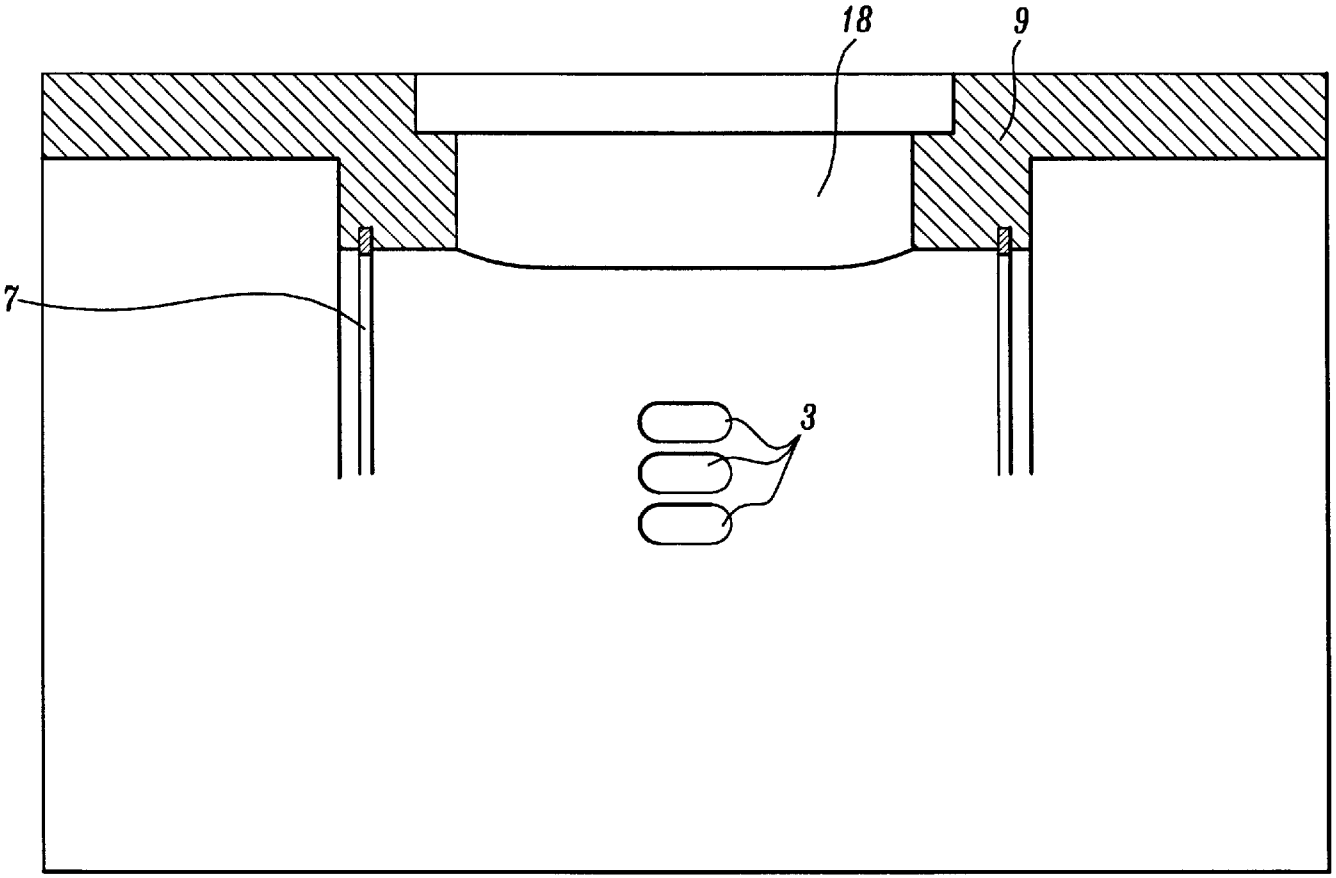
FIG. 7 is a cross-sectional view of an internal combustion engine formed in accordance with the present invention showing the housing, exhaust ports and the piston rings.

Referring now to FIG. 6, an end of the pistons 6 includes at least one piston ring 7. The diameter of this end of the piston 6 is substantially equal to the diameter of the cylinder. The rest of its length can favorably have a smaller diameter. The center of the pistons 6 are partly hollow to give access to the spark plug or injector hole 8.

The open end of the double cylinders 8 includes an annular precompression plate 13 attached thereto. The precompression plate 13 and the piston rings 7 engage the walls of the cylinders to define a seal therebetween. Each precompression plate 13 is fastened together to its cylinder and glides over the piston 6 between top dead center and bottom dead center.

The precompression plates 13 are mainly responsible for the different steps of the intake cycle.

Referring now to FIG. 11, the double cylinder housing 9 includes an intake chamber 17. The intake chamber 17 is closed off by a cylinder housing plate 15. The cylinder housing plate 15 holds a primary reed valve assembly 14 and the piston 6.

Each double cylinder housing 9 has a slot 18 located on each side of the cylinder. Each slot 18 is in the center along the line of the cylinder bore. The slots 18 are fashioned in a way, such that the cylinder journal pins 2, extending through the double cylinder housing 9, glide freely throughout its stroke length.

Figure 1B:
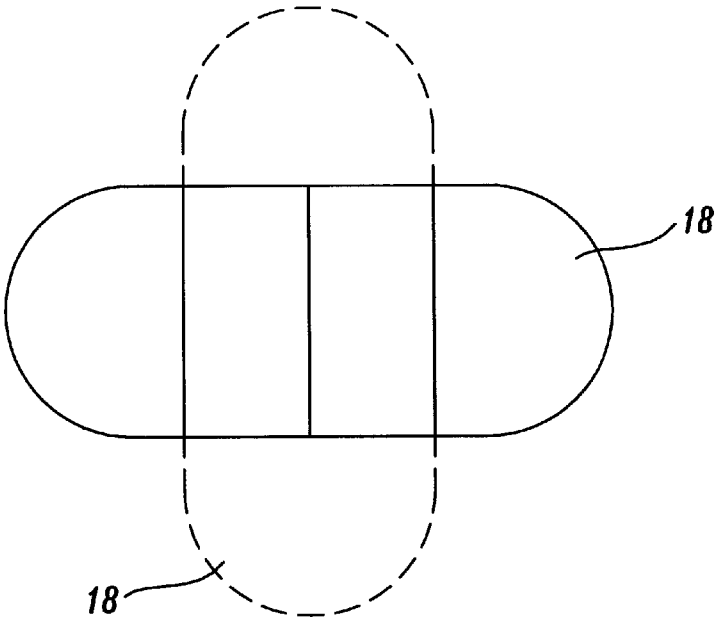
FIG. 1B illustrates the motion and common center point of an internal combustion engine formed in accordance with the present invention.
Figure 1A:
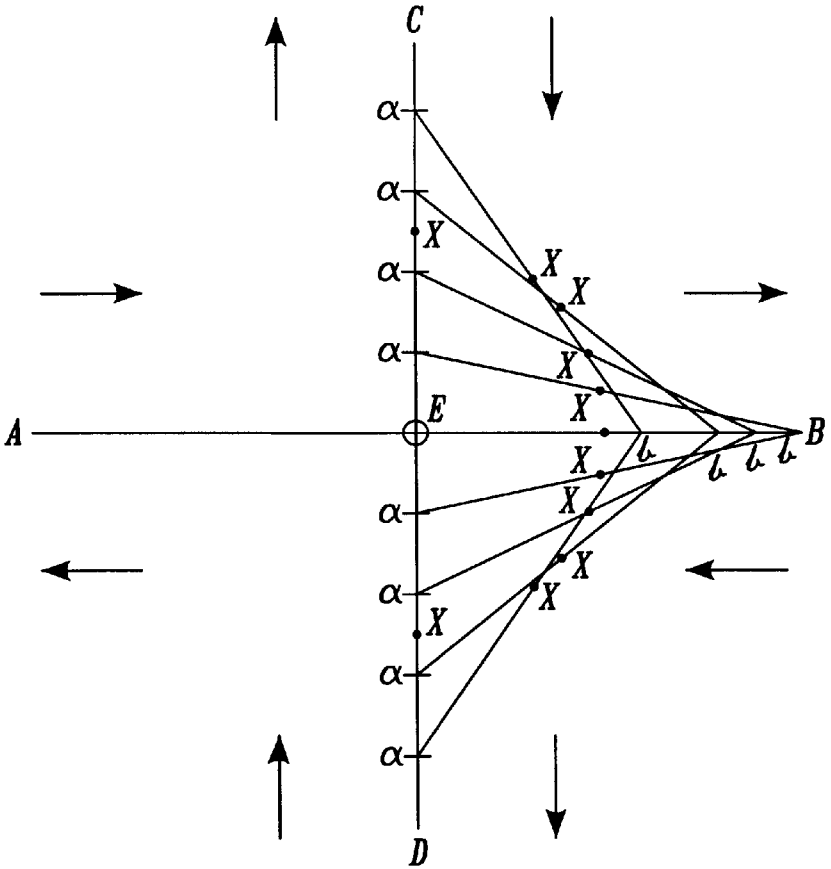
FIG. 1A is a diagrammatic view showing the linear and rotary displacement of an internal combustion engine formed in accordance with the present invention.

Still referring to FIG. 11, two double cylinder housings 9 are connected together at a ninety degree angle. The pair of double cylinder housings 9 are positioned such that the slots 18 face each other in the same angle and have the same centerpoint, as seen in FIG. 1.

Referring back to FIGS. 11 and 12, the two cylinder journal pins 2 are eccentrically connected to each other in a crankshaft type way, such that their centerlines are one-half stroke distance apart. On both ends of the cylinder journal pin 2 is a power takeoff shaft 12 connected to the pin 2 by a power takeoff ("PTO") journal 11. The center of the PTO journal 11 is located on a line located halfway between the centerlines of the connected cylinder journal pint 2.

Figure 2:
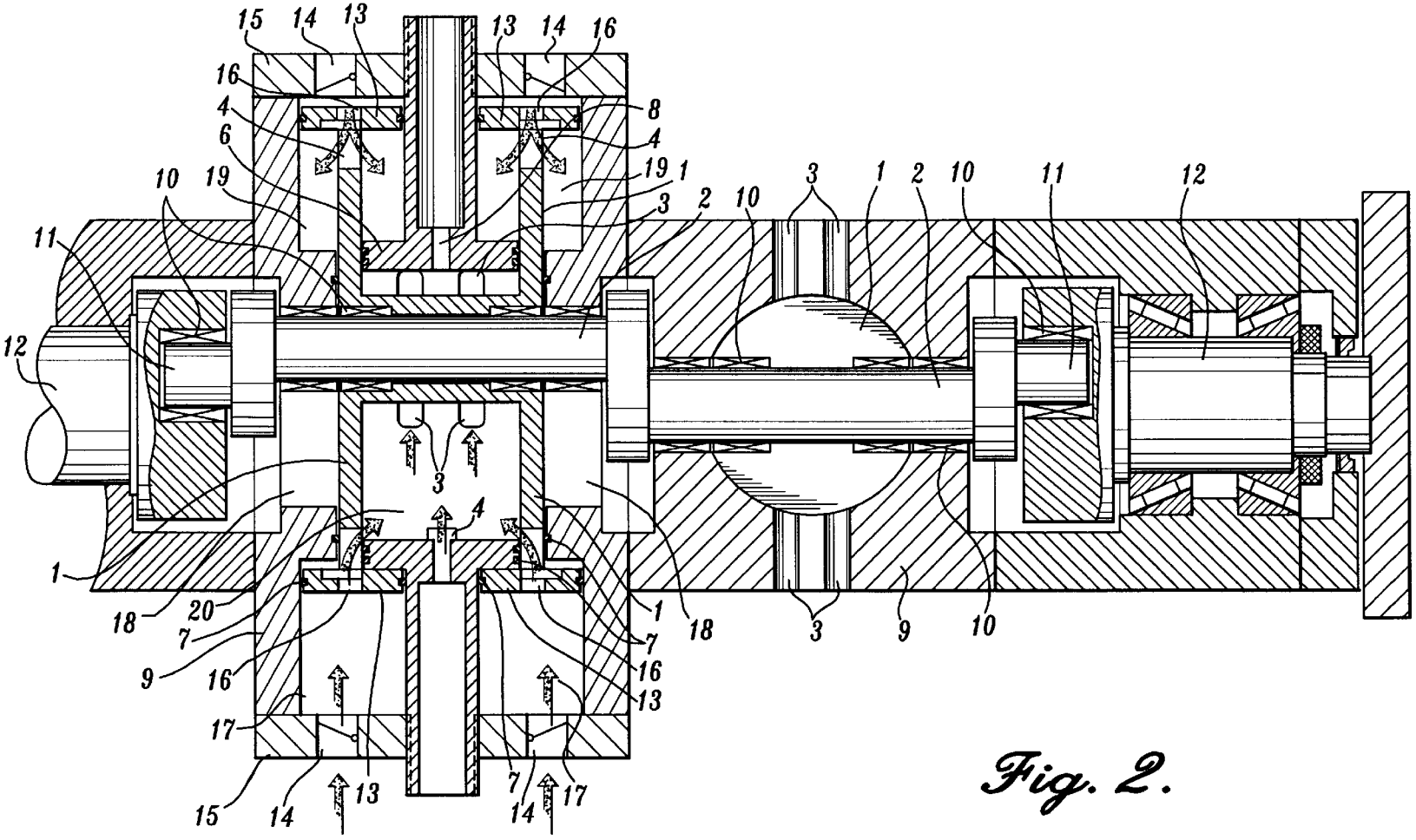
FIG. 2 is a cross-sectional side view of an internal combustion engine formed in accordance with the present invention showing a first set of cylinders extending normal to a second set of cylinders, wherein each set of cylinders are in contact with a reciprocating and rotating mechanism.
Figure 3:
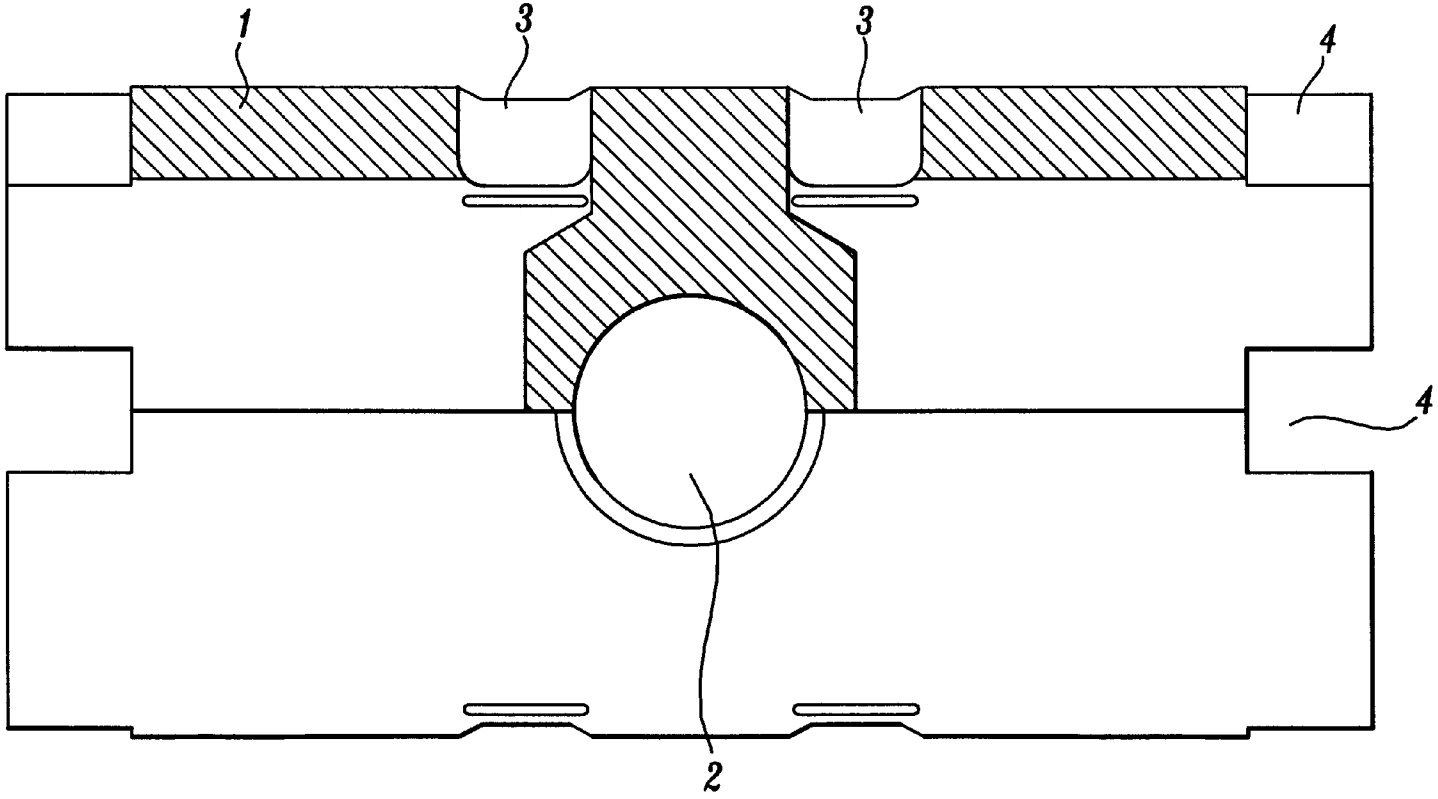
FIG. 3 is a cross-sectional view of a portion of an internal combustion engine formed in accordance with the present invention showing the exhaust ports, intake ports and the reciprocating and rotating mechanism.
Figure 4:
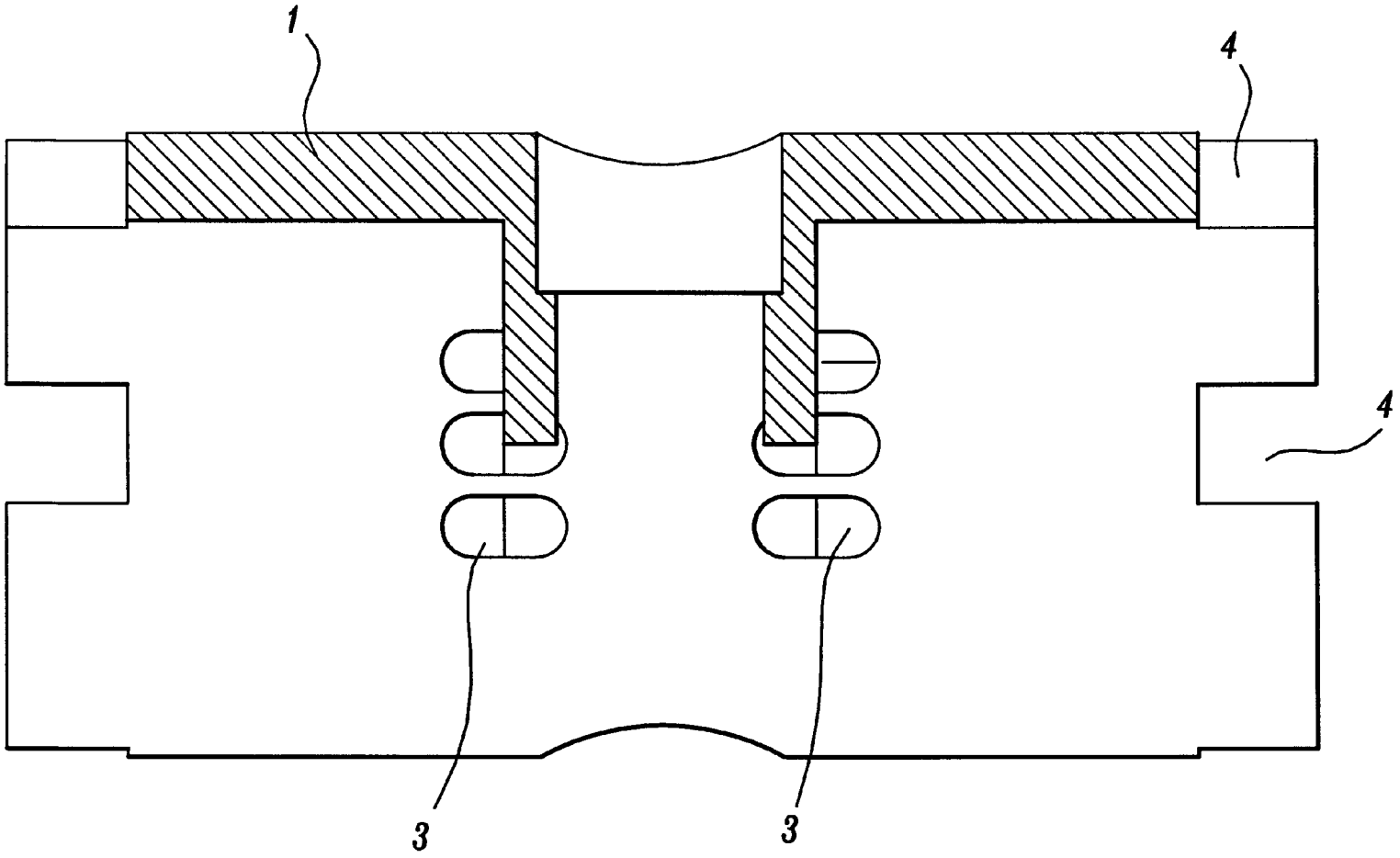
FIG. 4 is a cross-sectional view of an internal combustion engine formed in accordance with the present invention showing a cylinder, intake ports and exhaust ports.

The PTO journals 11 may be set in bearings 10 located in the PTO shafts 12. The centerline of the PTO shafts 12 match the centerline of the motor assembly, as seen in FIG. 2.

The cylinder journal pins 2 move the distance of the stroke in a straight line, and are guided by the double cylinder assembly, the slots 18 and the connection in a ninety degree angle of the cylinder housings 9. The whole cylinder pin assembly rotates at the same time in itself around the PTO shaft 12 centerline. Thus, the cylinder journal pin 2 has two axes of rotation. The first axis of rotation is defined by a longitudinal axis extending through the elongate direction of the cylinder journal pin 2. The second axis of rotation is defined normal to a point defined midway between the ends of the stroke length of the cylinders.

The transformation of the straight motion into a circular motion is based on the following:

FIG. 1: Two lines AB and CD having the same length cross each other at a right angle (ninety degrees) at the halfway point E of each line. A line ab equal to half the length of AB or CD moves with its point a on the line CD from point C to D and back. At the same time point b moves on line AB from A to B and back. This demonstrates the straight motion of the connected cylinder journal pin 2. As a result, point X located at the halfway point of line ab moves in a circle. This demonstrates the circular motion of the PTO journal 11 and cylinder journal pin 2. The PTO journal 11 rotates the PTO shaft 12.

Air or air/fuel mixture enters the intake chamber 17 through the primary reed valve assembly 14 into the intake chamber 17 during the combustion stroke. The intake chamber 17 is favorably bigger than the actual cylinder displacement.

The precompression plate 13 which is attached to the double cylinder 1 transfers the air or air/fuel mixture during the compression stroke through a secondary reed valve assembly 16 located in the precompression plate 13 into the precompression chamber.

The same can be done over transfer ports 21 located in the cylinder housing and piston shaft, as seen in FIG. 11. At the combustion stroke the air/mixture enters close at the bottom dead center position through the intake ports 4 and into a cylinder chamber 20. It pushes out the rest of the gases from combustion through the already open cylinder exhaust ports 3 which match in this position the exhaust ports located in the cylinder housing 9.

As the cylinder 1 starts the compression stroke, the intake ports 4 close, the exhaust ports 3 stop to match and the cylinder chamber 20 is sealed. As a result of the oversized intake chamber 17 the cylinder chamber 20 gets a charge comparable to that of a super or turbocharged engine. It gets this already at lowest rpm, as soon as the throttle is completely open.

Through the lack of connecting rods and its corresponding movement around the crankshaft, friction on the cylinder walls is reduced. The diagram of the piston speed, in this case cylinder speed, changes favorably at any rpm.

The combustion pressure is also better and there is a more efficient transformation of energy into mechanical power.

Figure 12:
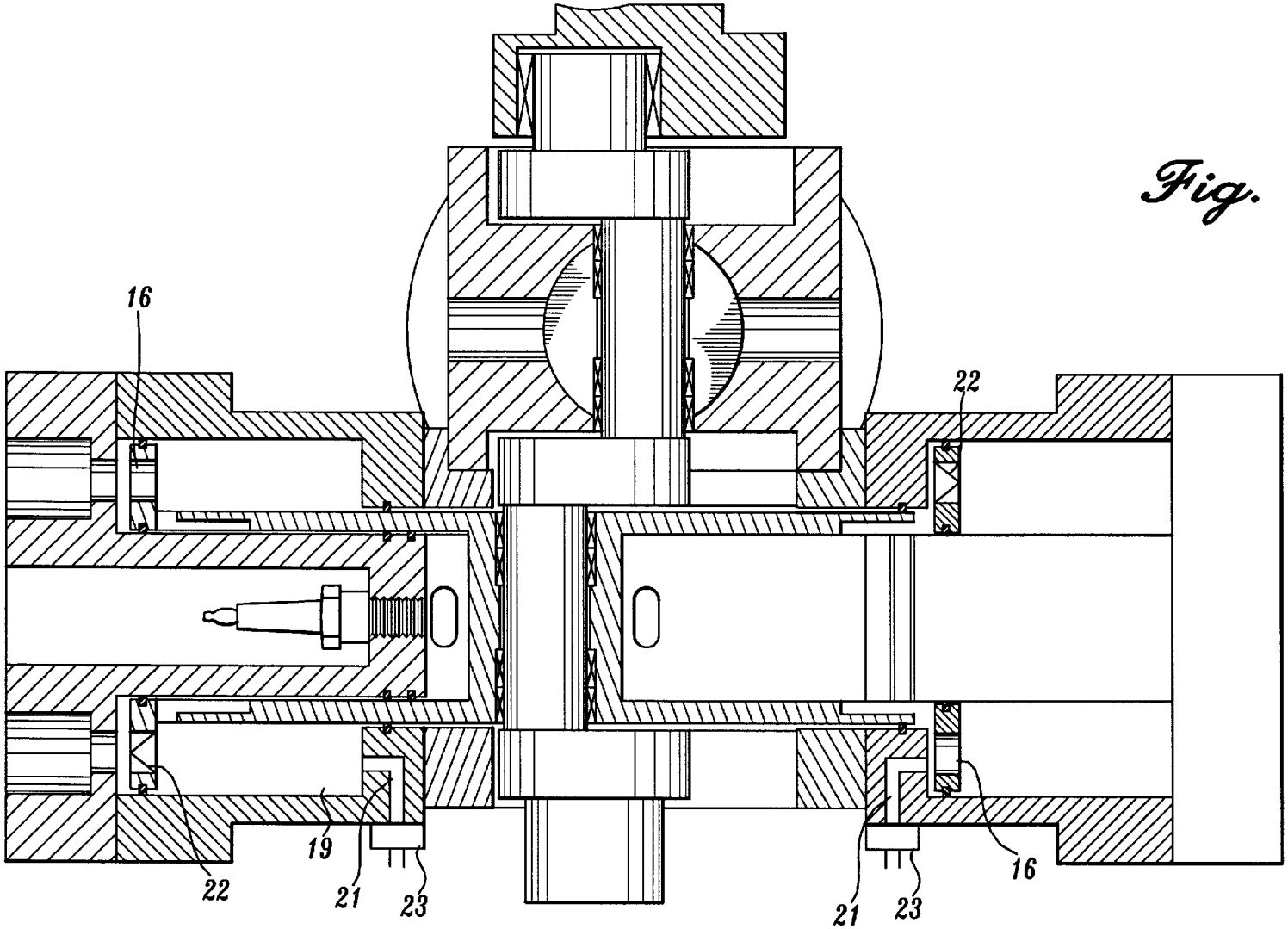
FIG. 12 is a cross-sectional side view of an internal combustion engine formed in accordance with the present invention showing the major components of the engine with an over pressure valve attached to the cylinders.

FIG. 12 illustrates the same principle for a normal piston-cylinder arrangement.

Figure 13:
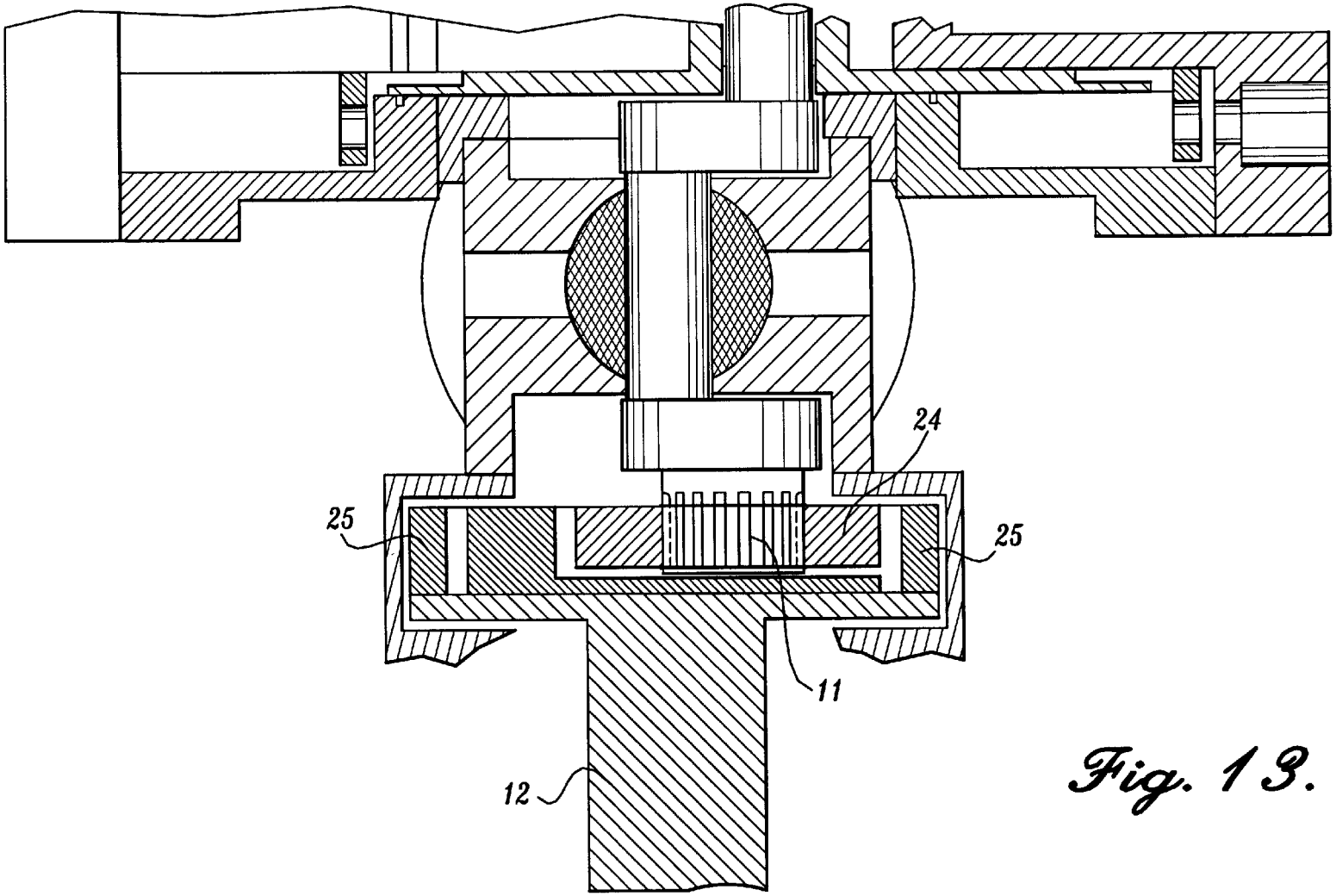
FIG. 13 is a cross-sectional view of an internal combustion engine formed in accordance with the present invention showing a reduction plate attached to one end of the reciprocating and rotating mechanism.

FIG. 13 shows the same as FIG. 2, just with other dimensions.

Figure 14:
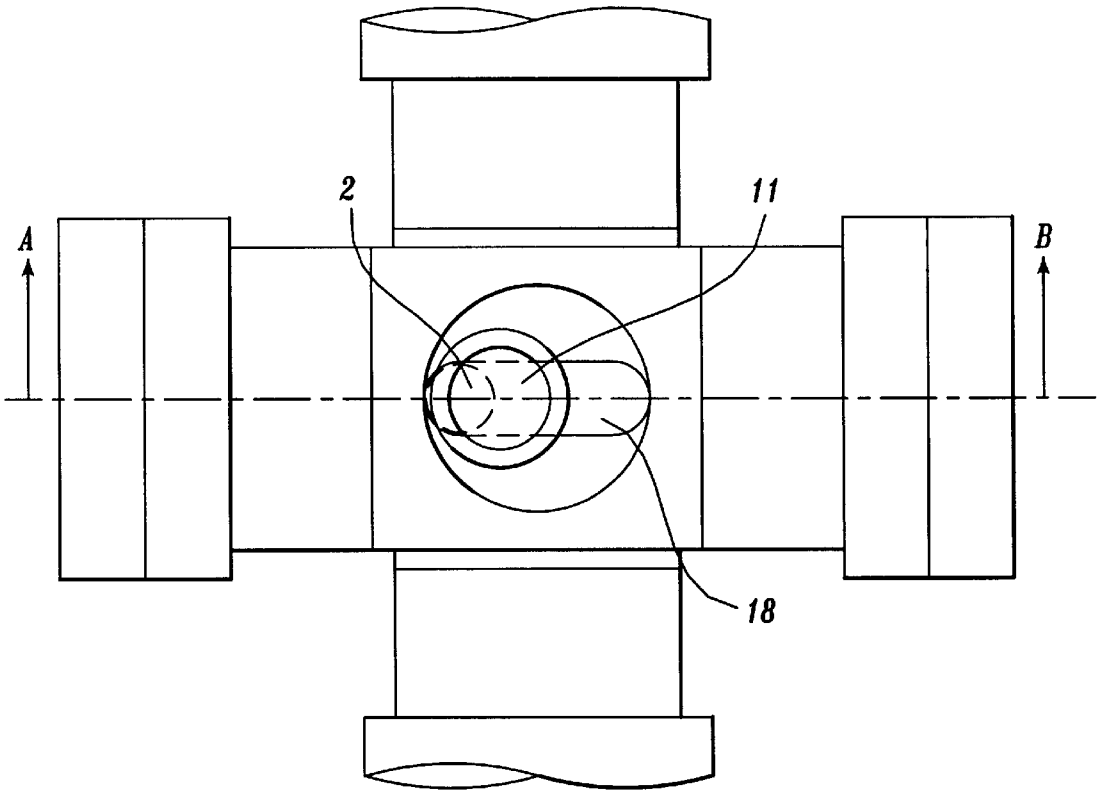
FIG. 14 is a side view of an internal combustion engine formed in accordance with the present invention showing the power take off journal.
Figure 15:
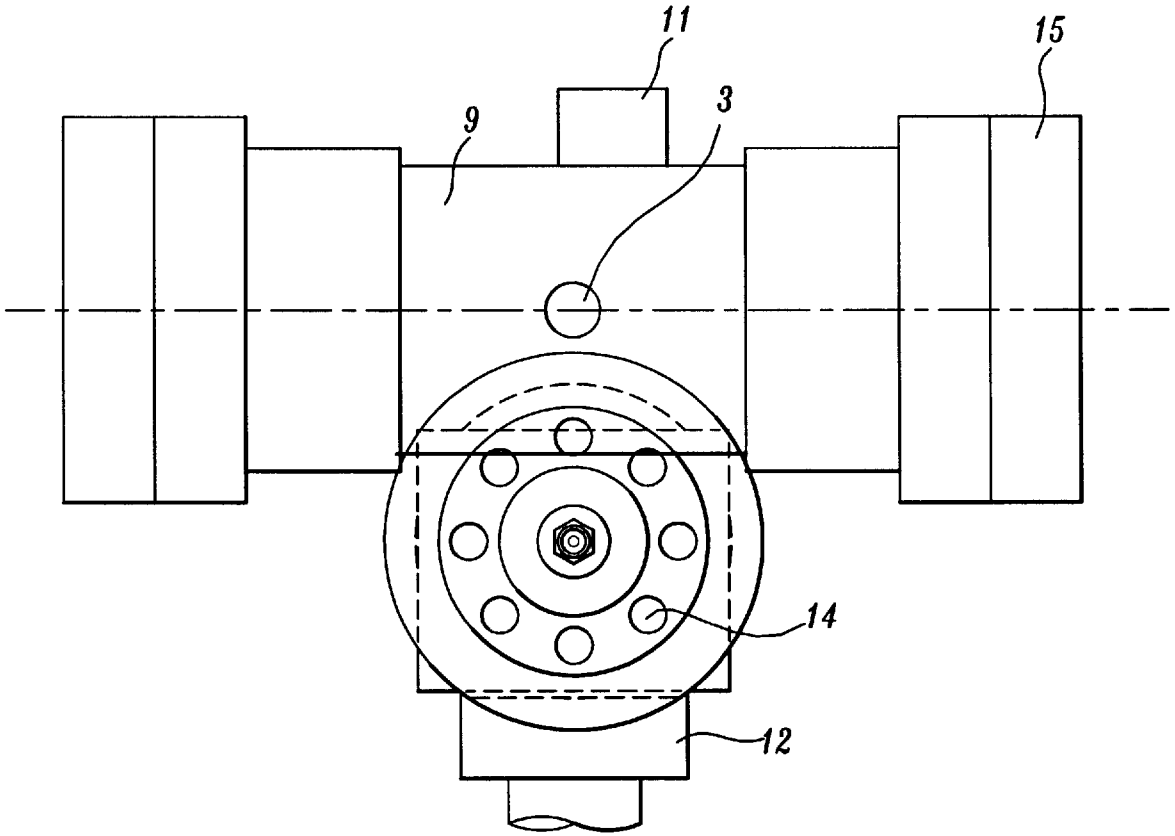
FIG. 15 is an end view of an internal combustion engine formed in accordance with the present invention showing the reed valve assembly attached to the power take off shaft.
Figures 17A, 17B, 17C, 17D, 17E, 17F, 17G, 17H:
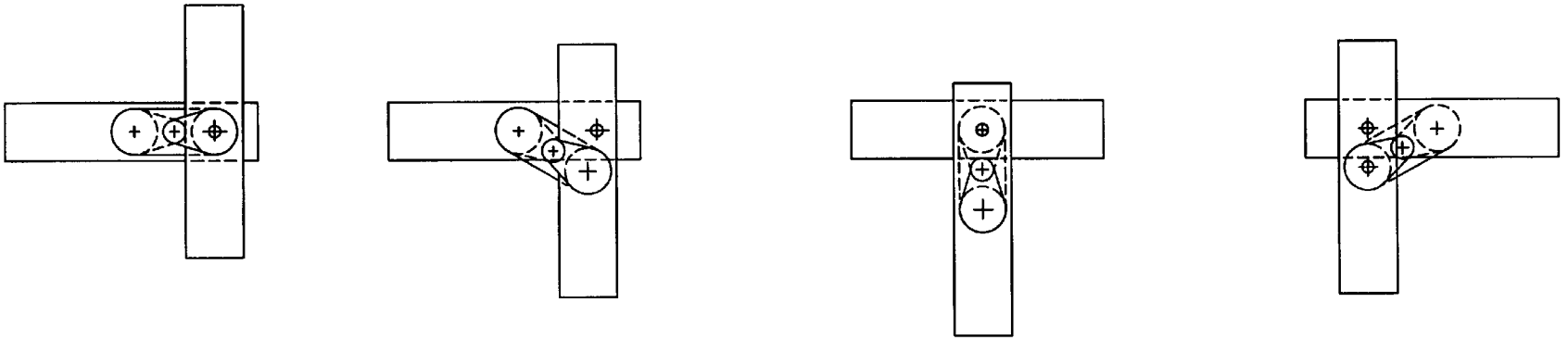
FIG. 17 illustrates the motion of the cylinder assembly for an internal combustion engine formed in accordance with the present invention.

In FIG. 14, over pressure valves 22 are positioned between the reed valves of the secondary reed valve assembly 16. After reaching a certain precompression, depending on adjustment, a surplus of air/fuel mixture at precompression is bleeding back into the intake chamber 17.

Independent from the altitude of operation or the rpm of the engine, as long as the adjusted precompression is reached, the engine will deliver its full horsepower and torque range.

Located at the bottom of the precompression chamber 19 are one or more cylinder housing vent holes 21. The vent holes 21 lead over compressor reed valves 23 to air hose connections located anywhere on the engine or the vehicle in which the engine is installed. In a diesel engine, surplus air might be used for compressor purposes during normal operation of the engine from any one or all cylinders.

In gasoline engines only a part of the cylinders can be used that way on demand. In this situation air for these particular cylinders has to bypass a carburator.

In fuel injected gas engines, a bypass is not necessary as long as the injectors for the cylinders are shut off.

This guarantees that only air is compressed.

A part of the gas engine keeps operating and powers the compressor part if selected. After the compressor is not needed and the air hose or other appliance is disconnected, the vent holes are automatically closed and the engine is switched back to normal operation on all cylinders.

Referring to FIG. 13, a gear 24 is attached to the PTO journal 11. The gear 24 rotates like the PTO journal 11 and the cylinder journal pin 2 around itself. At the same time it rotates with its centerline around the centerline of the power takeoff shaft 12 to which an inside gear ring 25 is attached.

If the gear 25 rotates 360° it has to cam its teeth twice with the teeth of the gear ring 25.

Through the manipulation of diameters and the possible amount of teeth involved different reduction ratios of the actual engine rpm to a desired PTO shaft 12 rpm is possible. In the example of FIG. 13 the gear 24 on the PTO journal 11 has 30 teeth. The gear ring 25 on the PTO shaft 12 has 40 teeth. At one 360° rotation of the cylinder pin assembly and the gear 24 around its centerline, the gear has to cam 60 teeth at the gear ring 25. The gear ring 25 has only 40 teeth, therefore it has to rotate in the process the distance of 20 teeth, what amounts to a 180° rotation of the PTO shaft 12. A ratio of a 2:1 rpm reduction is accomplished.

FIGS. 18 and 19 show the only three major moving parts of a four cylinder engine. The two double cylinders 1 and the cylinder pin assembly with the two cylinder pins 2 and the PTO journal 11. Steps one to eight demonstrate one 360° rotation in one quarter stroke increments. Engines with more or less than four cylinders can be built.

All known systems of carburation, fuel injection or additional use of turbochargers, compressors and blowers can be used on this engine, necessary or not. Also, all known types of ignition systems, lubrication systems, cooling systems, emission control systems and other engine related known systems can be adapted and, therefore, are within the scope of the present invention.

While the preferred embodiment of the invention has been illustrated and described, it will be appreciated that various changes can be made therein without departing from the spirit and scope of the invention.

I claim:

1. An internal combustion engine, comprising:

(a) a housing having first and second chambers formed in opposite ends of the housing, the chambers extending from the exterior of the housing to a predetermined point therein;

(b) a first piston assembly rigidly fastened within one of the chambers and a second piston assembly fastened within the other of the chambers;

(c) a cylinder reciprocably imnounted within each one of the chambers, the cylinders being mounted within the chambers such that a portion of the first piston assembly is received within one of the cylinders and a portion of the second piston assembly is received within the other of the cylinders, and (d) a reciprocating and rotating mechanism having at least one end rotatably disposed within the housing for transferring energy from the engine to a power take off shaft attachable to the end of the reciprocating and rotating mechanism, the reciprocating and rotating mechanism being disposed between the cylinders for reciprocating the cylinders along a predetermined stroke length during operation of the engine.

2. The internal combustion engine of claim 1, wherein the reciprocating and rotating mechanism rotates about two axes of rotation.

3. The internal combustion engine of claim 2, wherein the first axis of rotation is defined by a longitudinial axis extending through the reciprocating and rotating mechanism and the second axis of rotation is defined by an axis extending normal to a second longitudinal axis extending between the ends of the stroke length.

4. The internal combustion engine of claim 3, further comprising at least one intake port and at least one exhaust port extending through the cylinders, the intake port and exhaust port being vertically spaced within each cylinders.

5. The internal combustion engine of claim 4, wherein the engine is a two cycle engine.

6. The internal combustion engine of claim 4, further comprising third and fourth chambers formed in opposite ends of the housing and orthogonally to the first and second chambers, the third and fourth chambers each having a piston assembly rigidly fastened within the chambers, the third and fourth chambers each also include a cylinder reciprocably mounted therein for operation as a four cylinder internal combustion engine.

7. The internal combustion engine of claim 5, further comprising at least one over-pressure valve disposed on at least one of the cylinders, the valve being in fluid communication with the respective chamber in which the at least one of the cylinders is mounted within for high altitude compensation.

8. The internal combustion engine of claim 7, further comprising at least one over-pressure valve disposed on at least one of the cylinders, the valve being in fluid communication with the respective chamber in which the at least one of the cylinders is mounted within for arranging a torque.

9. The internal combustion engine of claim 5, further comprising at least one over-pressure valve disposed on at least one of the cylinders, the valve being in fluid communication with the respective chamber in which the at least one of the cylinders is mounted within for arranging a torque.

10. The internal combustion engine of claim 5, further comprising a reduction system coupled to the reciprocating and rotating mechanism for adjusting the engine rotation per minute to a predetermined rotation at the power take off shaft end of the reciprocating and rotating mechanism.

11. The internal combustion engine of claim 5, further comprising at least one piston ring located about the circumference of the piston assembly to define a seal between the piston assembly and the cylinder.

12. An internal combustion engine, comprising:

(a) a housing having at least first and second pairs of chambers formed in the housing, each chamber extending from the exterior of the housing to a predetermined point therein, the first pair of chambers being aligned within the housing along a first axis, the second pair of chambers being aligned within the housing along a second axis extending substantially normal to the first axis;

(b) a plurality of piston assemblies, each chamber having one of the piston assemblies rigidly fastened therein;

(c) a cylinder reciprocably mounted within each of the chambers on an elongate cylinder pin assembly, the cylinder pin assembly extending within the housing and disposed between the cylinders for reciprocating the cylinders along a predetermined stroke length and in an opposed manner during operation of the engine, the cylinder pin assembly having two axes of rotation; and (d) a power take off shaft coupled to an end of the cylinder pin assembly for transmitting energy generated by operation of the engine.

13. The internal combustion engine of claim 12, wherein the first axis of rotation is defined by a longitudinal axis extending through the elongate direction of the cylinder pin assembly and the second axis of rotation is defined by an axis extending normal to a second longitudinal axis between the ends of the stroke length.

14. The internal combustion engine of claim 13, further comprising at least one intake port and at least one exhaust port extending through each chamber, the intake port and exhaust port being vertically spaced within each chamber.

15. The internal combustion engine of claim 14, further comprising at least one over-pressure valve disposed on at least one of the cylinders, the valve being in fluid communication with the respective chamber in which the at least one of the cylinders is mounted within for high altitude compensation.

16. The internal combustion engine of claim 14, further comprising a reduction system coupled to the cylinder pin assembly for adjusting the engine rotation per minute to a predetermined rotation at the power take off shaft.

17. A two stroke internal combustion engine, comprising:

(a) a housing having at least first and second pairs of chambers formed in the housing, each chamber extending from the exterior of the housing to a predetermined point therein, the first pair of chambers being aligned within the housing along a first axis, the second pair of chambers being aligned within the housing along a second axis extending substantially normal to the first axis;

(b) at least one intake port and at least one exhaust port extending through each chamber, the intake port and exhaust port being vertically spaced within each chamber.

(c) a plurality of piston assemblies, each chamber having one of the piston assemblies rigidly fastened therein;

(d) a cylinder reciprocably mounted within each of the chambers, an elongate cylinder pin assembly, the cylinder pin assembly extending within the housing and disposed between the cylinders for reciprocating the cylinders along a predetermined stroke length and in an opposed manner during operation of the engine, the cylinder pin assembly having two axes of rotation, wherein the first axis of rotation is defined by a longitudinal axis extending through the elongate direction of the cylinder pin assembly and the second axis of rotation is defined by an axis extending normal to a second longitudinal axis extending between the ends of the stroke length; and (e) a power take off shaft coupled to an end of the cylinder pin assembly for transmitting energy generated by operation of the engine.

18. The two stroke internal combustion engine of claim 17, further comprising at least one over-pressure valve disposed on at least one of the cylinders, the valve being in fluid communication with the respective chamber in which the at least one of the cylinders is mounted within for high altitude compensation.

19. The internal combustion engine of claim 17, further comprising a reduction system coupled to the cylinder pin assembly for adjusting the engine rotation per minute to a predetermined rotation at the power take off shaft.

20. An internal combustion engine, comprising:

(a) a housing having first and second chambers formed in opposite ends of the housing, the chain bers extending from the exterior of the housing to a predetermined point therein;

(b) a first piston assembly rigidly fastened within one of the chambers and a second piston assembly fastened within the other of the chamnbers;

(c) a cylinder reciprocably mounted within each one of the chambers, the cylinders being mounted within the chambers such that a portion of the first piston assembly is received within one of the cylinders and a portion of the second piston assembly is received within the other of the cylinders;

(d) a reciprocating and rotating mechanism having at least one end rotatably disposed within the housing for transferring energy from the engine to a power take off shaft attachable to the end of the reciprocating and rotating mechanism, the reciprocating and rotating mechanism being disposed between the cylinders for reciprocating the cylinders along a predetermined stroke length and relative to the fixed piston assemblies during operation of the engine, wherein the reciprocating and rotating mechanism rotates about two axes of rotation, wherein the first axis of rotation is defined by a longitudinal axis extending through the reciprocating and rotating mechanism and the second axis of rotation is defined by an axis extending normal to a second longitudinal axis extending between the ends of the stroke length;

(e) at least one intake port and at least one exhaust port extending through the cylinders, the intake port and exhaust port being vertically spaced within each cylinders; and (f) third and fourth chambers formed in opposite ends of the housing and orthogonally to the first and second chambers, the third and fourth chambers each having a piston assembly rigidly fastened to the chambers, the third and fourth chambers each also include a cylinder reciprocably mounted therein for operation as a four cylinder internal combustion engine.

21. An internal combustion engine, comprising:

(a) a housing having first and second chambers formed in opposite ends of the housing, the chambers extending from the exterior of the housing to a predetermined point therein;

(b) a first piston assembly rigidly fastened within one of the chambers and a second piston assembly fastened within the other of the chambers;

(c) a cylinder reciprocably mounted within each one of the chambers, the cylinders being mounted within lie chambers such that a portion of the first piston assembly is received within one of the cylinders and a portion of the second piston assembly is received within the other of the cylinders;

(d) a reciprocating and rotating mechanism having at least one end rotatably disposed within the housing for transferring energy from the engine to a power take off shaft attachable to the end of the reciprocating and rotating mechanism, the reciprocating and rotating mechanism being disposed between the cylinders for reciprocating the cylinders along a predetermined stroke length and relative to the fixed piston assemblies during operation of the engine, wherein the reciprocating and rotating mechanism rotates about two axes of rotation, wherein the first axis of rotation is defined by a longitudinal axis extending through the reciprocating and rotating mechanism and the second axis of rotation is defined by all axis extending normal to a second longitudinal axis extending between the ends of the stroke length;

(e) at least one intake port and at least one exhaust port extending through the cylinders, the intake port and exhaust port being vertically spaced within each cylinders, wherein the engine is a two cycle engine; and (f) a reduction system coupled to the reciprocating and rotating, mechanism for adjusting the engine rotation per minute to a predetermined rotation at the power take off shaft end of the reciprocating and rotating mechanism.

* * * * *